US008523169B2

(12) United States Patent
Inui

(10) Patent No.: US 8,523,169 B2
(45) Date of Patent: Sep. 3, 2013

(54) SHEET FEEDING APPARATUS AND IMAGE FORMING APPARATUS

(75) Inventor: Fumiki Inui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/564,139

(22) Filed: Aug. 1, 2012

(65) Prior Publication Data

US 2013/0038016 A1 Feb. 14, 2013

(30) Foreign Application Priority Data

Aug. 8, 2011 (JP) ..... 2011-172872

(51) Int. Cl.
*B65H 5/00* (2006.01)

(52) U.S. Cl.
USPC ..... 271/10.01; 271/162; 271/171

(58) Field of Classification Search
USPC ..... 271/10.01, 18, 145, 162, 171
See application file for complete search history.

(56) References Cited

U.S. PATENT DOCUMENTS 6,671,488 B2 12/2003 Izawa et al.
7,130,572 B2 10/2006 Kubochi et al.
7,789,388 B2 9/2010 Matsubara et al.
7,810,809 B2 10/2010 Inui
2006/0113725 A1* 6/2006 Ito ..... 271/171

FOREIGN PATENT DOCUMENTS

JP 2007-197184 A 8/2007

* cited by examiner

*Primary Examiner* — David H Bollinger

(74) *Attorney, Agent, or Firm* — Fitzpatrick, Cella, Harper & Scinto

(57) ABSTRACT

A sheet feeding apparatus and an image forming apparatus, which can improve sheet feeding performance at low cost without degrading usability, are provided. Projections 42T and 43T are provided in abutting surfaces, which abut on lateral end of a sheet S, of a pair of lateral-end regulating portions 42 and 43 provided opposite each other. The projections regulates climbing over the lateral-end regulating portions of the sheet S when the sheet S is fed. Guide projections 100*a* and 100*c* are provided opposite each other along a cassette attaching direction in an inner wall surface of an attaching space, in which a sheet feeding cassette of an apparatus body is attached. When the sheet S climbs over the projections in feeding the sheet S, the sheet S is abutted on the guide projections to regulate upward movement of the sheet S.

14 Claims, 10 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, particularly to a configuration of a lateral-end regulating portion which regulates a lateral-end position of a sheet stored in a sheet feeding cassette detachably attached to the sheet feeding apparatus.

2. Description of the Related Art

Nowadays, an image forming apparatus in which a sheet feeding apparatus feeds a sheet to an image forming portion to form an image is widely spread in image forming apparatuses, such as a copying machine, a printer, and a facsimile machine. As to the sheet feeding apparatus, generally a sheet feeding cassette is detachably attached to an apparatus body, and the sheet stored in the sheet feeding cassette is automatically fed to an image forming portion.

For example, in some of the sheet feeding cassettes used in the sheet feeding apparatus, a sheet supporting plate which presses the stacked sheet against a feeding roller is provided while being able to be lifted and lowered. A rear-end regulating portion is slidably provided in the sheet feeding cassette in which the sheet supporting plate is provided. The rear-end regulating portion regulates a position at an end (hereinafter referred to as a rear end) on an upstream side in a sheet feeding direction of the sheet stacked and stored on the sheet supporting plate such that the sheets having different sizes can be stored. A pair of lateral-end regulating portions is also provided in order to regulate a lateral-end position in a direction (hereinafter referred to as a width direction) orthogonal to the sheet feeding direction.

The pair of lateral-end regulating portions regulates lateral ends of the sheet, and the rear-end regulating portion regulates the rear end of the sheet, whereby the sheet is always regulated in a predetermined position. Therefore, when the sheet feeding cassette is accommodated in the apparatus body, the sheet can be fed from the fixed position irrespective of a size of the sheet. In a sheet feeding cassette of the related art, a guide projection is provided in an upper end part of a sheet abutting surface of the lateral-end regulating portion such that an end part of the sheet does not climb over the lateral-end regulating portion when the sheet is fed.

When the sheet is left in a low-temperature, low-humidity environment, the sheet is warped (hereinafter referred to as curled), and both end parts of the sheet rise. As illustrated in FIG. 9A, when a sheet S is curled, a clearance K is generated between the end part of the sheet S and each of projections 42T and 43T, and therefore sometimes the end part of the sheet S climbs over lateral-end regulating portions 42 and 43 when feeding the sheet S.

When the end part of the sheet S climbs over the lateral-end regulating portions 42 and 43, the sheet S generates a skew feeding, or the sheet S is fed while deviated in the width direction. When sheet feeding performance is degraded in this way, possibly print accuracy is degraded, or a jam is generated. Meanwhile, when projection amounts of the projections 42T and 43T are increased in a sheet direction, the sheet S does not climb over the lateral-end regulating portions 42 and 43. However, the sheet S is hardly set, and possibly the projections 42T and 43T damage the end part of the sheet. Therefore, from the viewpoint of usability, it is not preferable that the projection amounts of the projections 42T and 43T be increased.

Conventionally, in order to solve the problem, projections 42*k* and 43*k* are rotatably provided in the lateral-end regulating portions 42 and 43 as illustrated in FIG. 9B (see Japanese Patent Laid-Open No. 2007-197184). When the sheet is set in the sheet feeding cassette disclosed in Japanese Patent Laid-Open No. 2007-197184, the projections 42*k* and 43*k* are rotated in direction of an arrow C about guide projection centers 42*s* and 43*s*, which allows the sheet to be set without degrading the usability.

In the sheet feeding apparatus of the related art, it is necessary that the projections 42*k* and 43*k* be returned to climbing-over regulating positions parallel to the sheet after the projections 42*k* and 43*k* are rotated in the direction of the arrow C to set the sheet. However, as illustrated in FIG. 9B, in order to return the projections 42*k* and 43*k* to the climbing-over regulating positions, a height of the sheet feeding apparatus is increased by a projection amount F of the guide projection, and the number of components is increased to lead to an increase in cost.

Therefore, the invention is aimed at a sheet feeding apparatus and an image forming apparatus, which can improve the sheet feeding performance at low cost without degrading the usability.

SUMMARY OF THE INVENTION

A sheet feeding apparatus according to an aspect of the invention, includes: a sheet feeding cassette detachably attached to an apparatus body, which stores sheets; a sheet feeding portion feeds a sheet stored in the sheet feeding cassette; a pair of lateral-end regulating portions which is provided in the cassette to regulate a lateral-end position of the sheet in a width direction orthogonal to a sheet feeding direction; a regulating portion which is projected from an abutting surface of each of the pair of lateral-end regulating portions, the abutting surface abutting on a lateral end of the sheet, the regulating portion regulating climbing over the pair of lateral-end regulating portions of the sheet when the sheet is fed; and an upper regulating portion which is provided in an inner wall surface of an attaching space, in which the sheet feeding cassette of the apparatus body is attached, and regulates the sheet when the sheet climbs over the regulating portion.

A sheet feeding apparatus according to another aspect of the invention in which a sheet feeding portion feeds a sheet stored in a sheet feeding cassette detachably attached to an apparatus body, the sheet feeding apparatus includes: a pair of lateral-end regulating portions which is provided in the cassette to regulate a lateral-end position of the sheet in a width direction orthogonal to a sheet feeding direction; a regulating portion which is projected to a position higher than an upper surface of the stacked sheet in an abutting surface of each of the pair of lateral-end regulating portions, the abutting surface abutting on a lateral end of the sheet; and an upper regulating portion which is projected onto the sheet feeding cassette side at a position higher than the regulating portion in an inner wall surface of an attaching space, in which the sheet feeding cassette of the apparatus body is attached.

According to the invention, when the sheet climbs over the lateral-end regulating portion, the upward movement of the sheet is regulated by the plural upper regulating portions, which are provided opposite each other in the inner wall surface of the attaching space. Therefore, the sheet feeding performance can be improved at low cost without degrading the usability.

Further features of the present invention will become apparent from the following description of exemplary embodiments with reference to the attached drawings.

DESCRIPTION OF THE EMBODIMENTS

Figure 1:
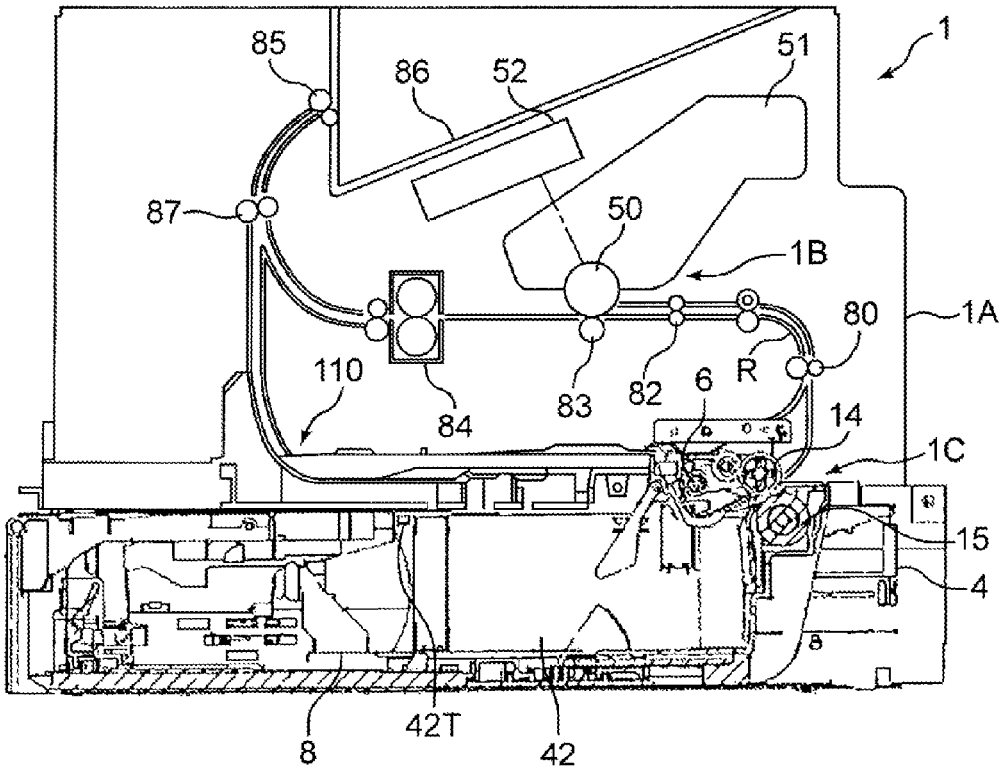
FIG. 1 is a view illustrating a schematic configuration of a laser beam printer which is of an example of an image forming apparatus provided with a sheet feeding apparatus according to a first embodiment of the invention.

Hereinafter, exemplary embodiments of the invention will be described in detail with reference to the drawings. FIG. 1 is a view illustrating a schematic configuration of a laser beam printer which is of an example of an image forming apparatus provided with a sheet feeding apparatus according to a first embodiment of the invention. Referring to FIG. 1, in a laser beam printer 1, a sheet feeding apparatus 1C which feeds a sheet to an image forming portion 1B is provided in a lower part of laser beam printer body (hereinafter referred to as an apparatus body) 1A.

The image forming portion 1B includes a cartridge unit 51, which is provided with a photosensitive drum 50 which is of an image bearing member, and a laser beam scanner 52 which exposes the photosensitive drum 50. During image formation, the laser beam scanner 52 exposes the photosensitive drum 50 to form a latent image in a photosensitive drum surface, and the latent image is developed to form a toner image on the photosensitive drum surface.

The sheet feeding apparatus 1C includes a sheet feeding cassette 4 which is of a sheet stacking portion detachably attached to the apparatus body 1A and a sheet feeding roller 6 which is provided above the sheet feeding cassette 4 to deliver a sheet stored in the sheet feeding cassette 4. The sheet feeding apparatus 1C also includes a feed roller 14 and a retard roller 15, which constitute a separation portion to separates the sheet delivered from the sheet feeding roller 6.

A sheet supporting plate 8 which presses the sheet against the sheet feeding roller side is provided in the sheet feeding cassette 4 so as to be able to be lifted and lowered. The sheet feeding cassette 4 is attached to the apparatus body 1A, which is also used as a sheet feeding apparatus body, from a direction of an arrow A in FIG. 3. The sheet feeding cassette 4 is pulled out from a direction of an arrow H.

In the configuration of the sheet feeding apparatus 1C, the sheet stored in the sheet feeding cassette 4 is delivered by the sheet feeding roller 6 in parallel with a toner-image forming operation of the image forming portion 1B. The sheets are separated one by one by the feed roller 14 and the retard roller 15. Then, pair of conveying rollers 80 the sheet to a pair of registration rollers 82, and the pair of registration rollers 82 conveys the sheet to a transfer portion, which is formed by the photosensitive drum 50 and a transfer roller 83, in predetermined timing.

The toner image formed on the photosensitive drum surface is transferred to the sheet conveyed to the transfer portion. Then the sheet is conveyed to a fixing device 84, and the sheet is heated and pressurized by the fixing device 84, thereby fixing the toner image. After the toner image is fixed, a pair of discharge rollers 85 discharges the sheet to a discharge portion 86 to a top surface of the apparatus body.

On the other hand, when the image is also formed on a second surface, after the sheet in which the image is already formed on one side passes through the fixing device 84, a pair of reverse rollers 87 performs switchback conveyance of the sheet, the sheet passes through a both-sided unit 110, and the pair of registration rollers 82 conveys the sheet to the transfer portion again. The image is formed on the opposite-side surface by the transfer portion, and then the sheet is discharged to the discharge portion 86.

Figure 2A:
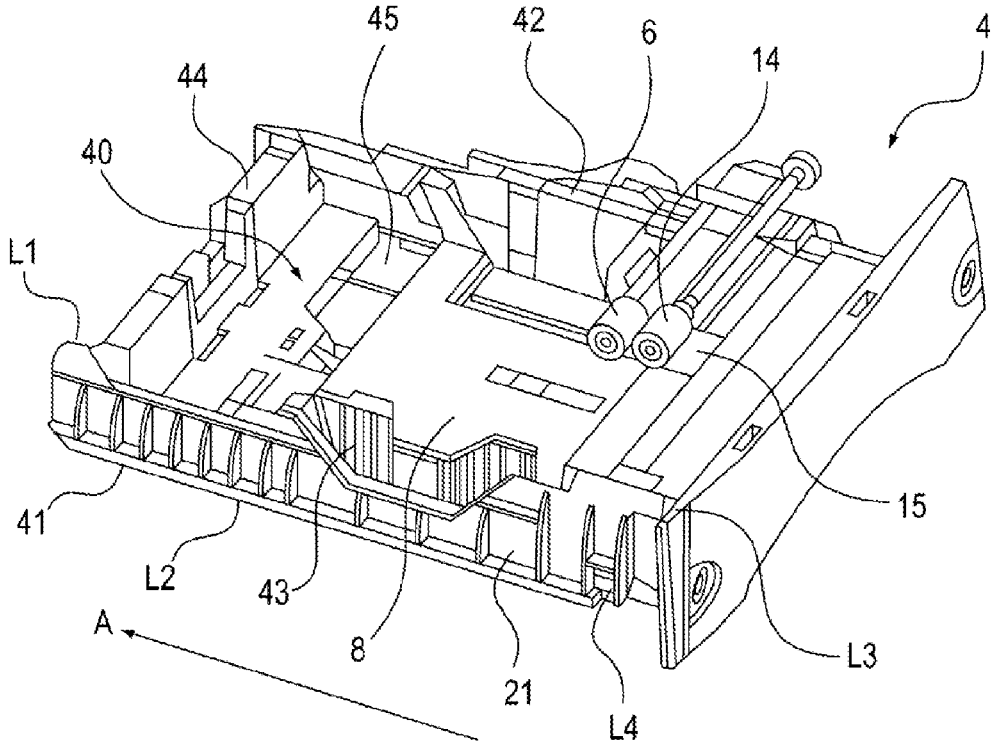
FIGS. 2A and 2B are first views illustrating a configuration of the sheet feeding apparatus.

As illustrated in FIG. 2A, the sheet feeding apparatus 1C includes the sheet feeding roller 6, the feed roller 14, and the retard roller 15, which constitute the sheet feeding portion. A sheet supporting plate 8, which is of the sheet stacking portion on which the sheet is stacked, is provided in the sheet feeding cassette 4 while being vertically rotatable. When the sheet is fed, the sheet supporting plate 8 rotates upward to be lifted to a feeding position in which the sheet can be fed.

Figure 2B:
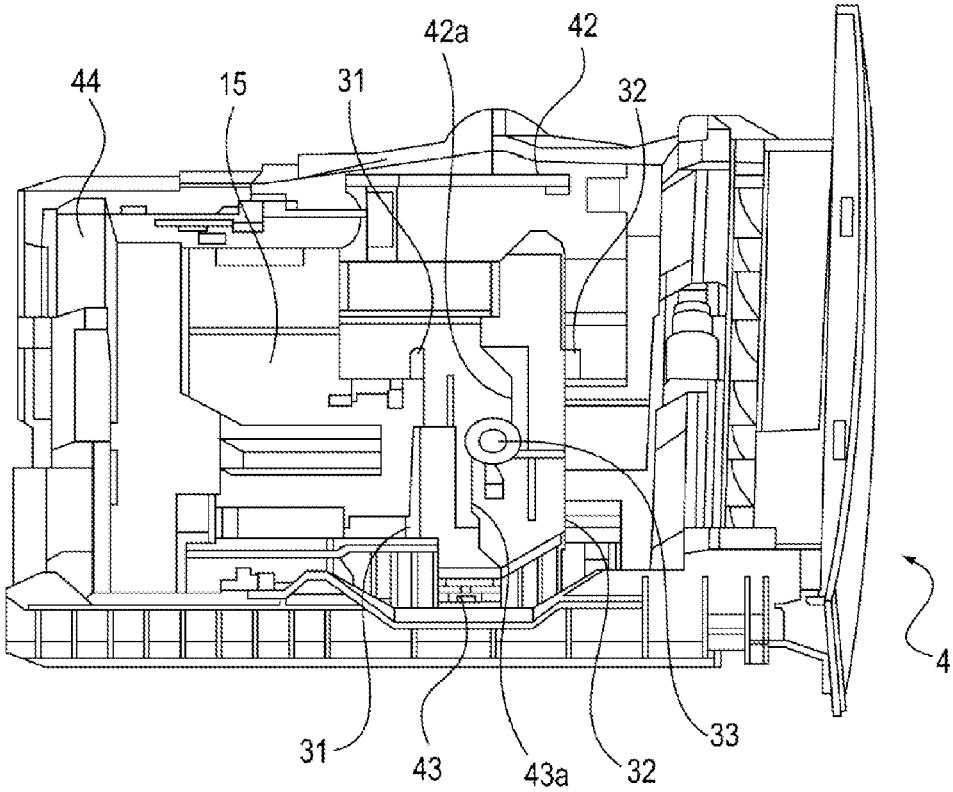

A rear end regulating portion 44 is slidably provided in the sheet feeding cassette 4. The rear end regulating portion 44 regulates a rear-end position of the sheet stacked and stored on the sheet supporting plate 8 such that the sheets having different sizes can be stored. A pair of lateral-end regulating portions 42 and 43 is provided opposite each other, and the lateral-end regulating portions 42 and 43 regulate a lateral-end position of the sheet in a width direction orthogonal to a sheet feeding direction. As illustrated in FIG. 2B, the lateral-end regulating portions 42 and 43 include rack portions 42*a* and 43*a*. The lateral-end regulating portions 42 and 43 are formed by molding plastic.

The lateral-end regulating portions 42 and 43 are configured to simultaneously move by the same amount in the width direction around a pinion gear 33 using the rack portions 42*a* and 43*a* and the pinion gear 33 provided in a bottom of the sheet feeding cassette 4. As illustrated in FIG. 9 described in the related art, projections 42T and 43T which are of a regulating portion are provided opposite each other on sheet abutting surfaces of the lateral-end regulating portions 42 and 43. In feeding the sheet, the projections 42T and 43T regulate climbing over the lateral-end regulating portions 42 and 43 of an end part of the sheet. The sheet feeding apparatus of the first embodiment is a guide-center device, in which the sheet is delivered while a center of the sheet in the width direction orthogonal to the sheet feeding direction is aligned with a center of a sheet conveying path in the width direction in the image forming apparatus. Therefore, as described above, the lateral-end regulating portions 42 and 43 contact with and separate from each other by the same moving amount such that the center of the sheet in the width direction is located in the same position even in the sheets having different sizes.

Figure 3A:
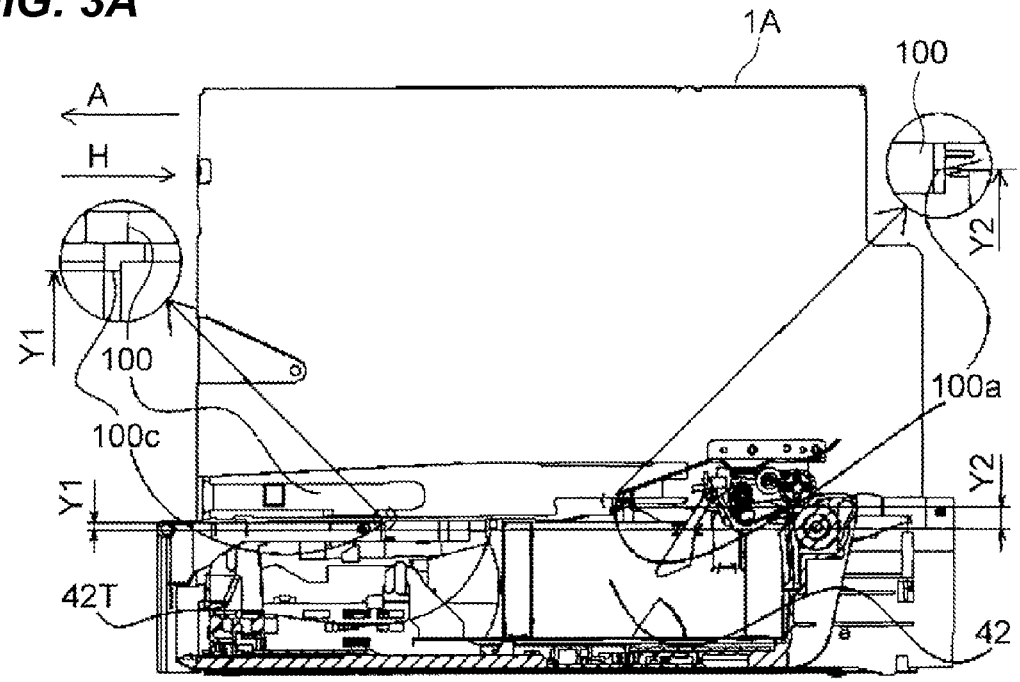
FIGS. 3A and 3B are second views illustrating the configuration of the sheet feeding apparatus.

In the first embodiment, the both-sided unit 110 is detachably attached to the apparatus body 1A. FIG. 3A illustrates a state before the both-sided unit 110 is attached to the apparatus body 1A, and FIG. 3B illustrates a state in which the both-sided unit 110 is attached to the apparatus body 1A.

Figure 4A:
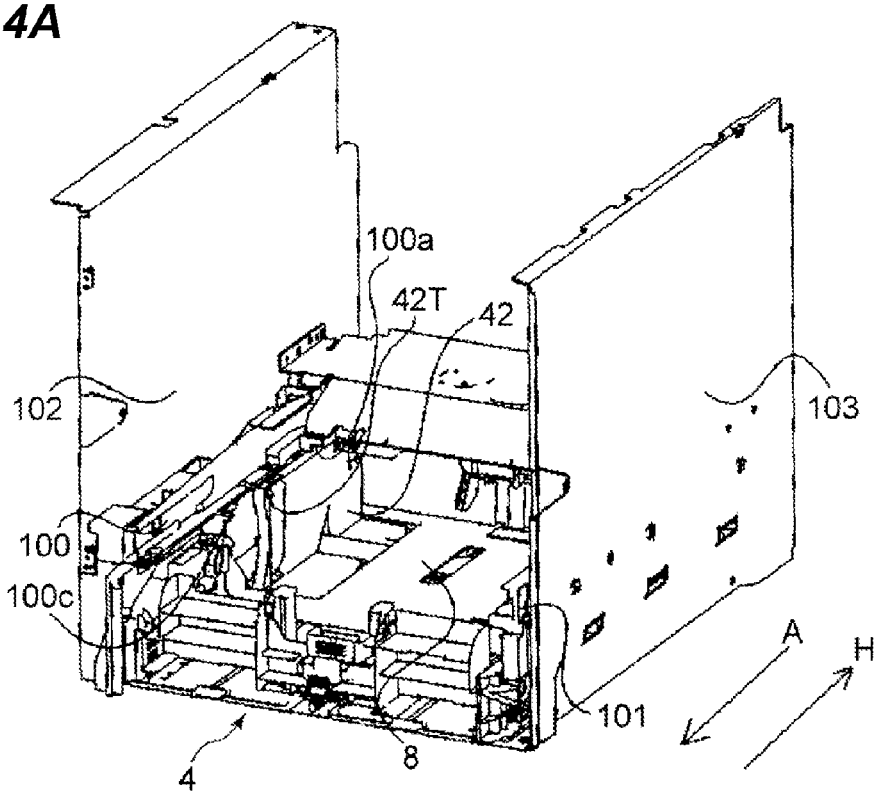
FIGS. 4A and 4B are third views illustrating the configuration of the sheet feeding apparatus.
Figure 4B:
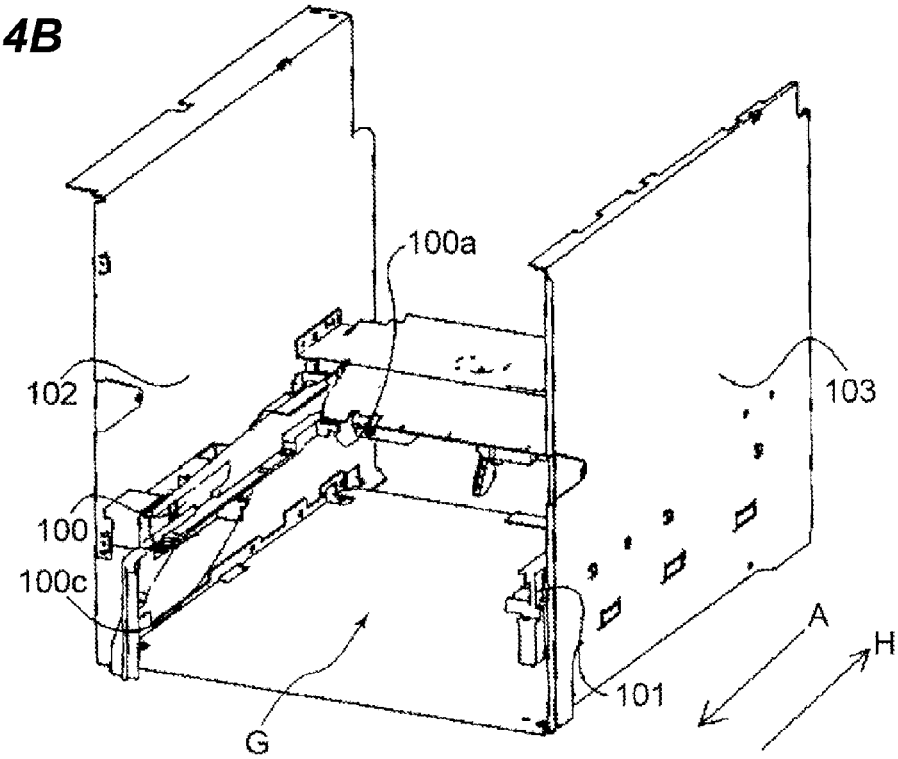

As illustrated in FIG. 4, guide members 100 and 101 are provided opposite each other along a cassette attaching direction in inner wall surfaces of opposite frames 102 and 103 of the apparatus body 1A such that the both-sided unit 110 can detachably be attached. The both-sided unit 110 is guided by the guide members 100 and 101, and attached to the apparatus body 1A. FIG. 4A illustrates a state in which the sheet feeding cassette 4 is attached to the apparatus body 1A, and FIG. 4B illustrates a state when the sheet feeding cassette 4 is pulled out from the apparatus body 1A. An attaching space G in which the sheet feeding cassette 4 is detachably attached is formed by the frames 102 and 103. The frames 102 and 103 and guide members 100 and 101 of the apparatus body 1A are formed by molding plastic.

Figure 3B:
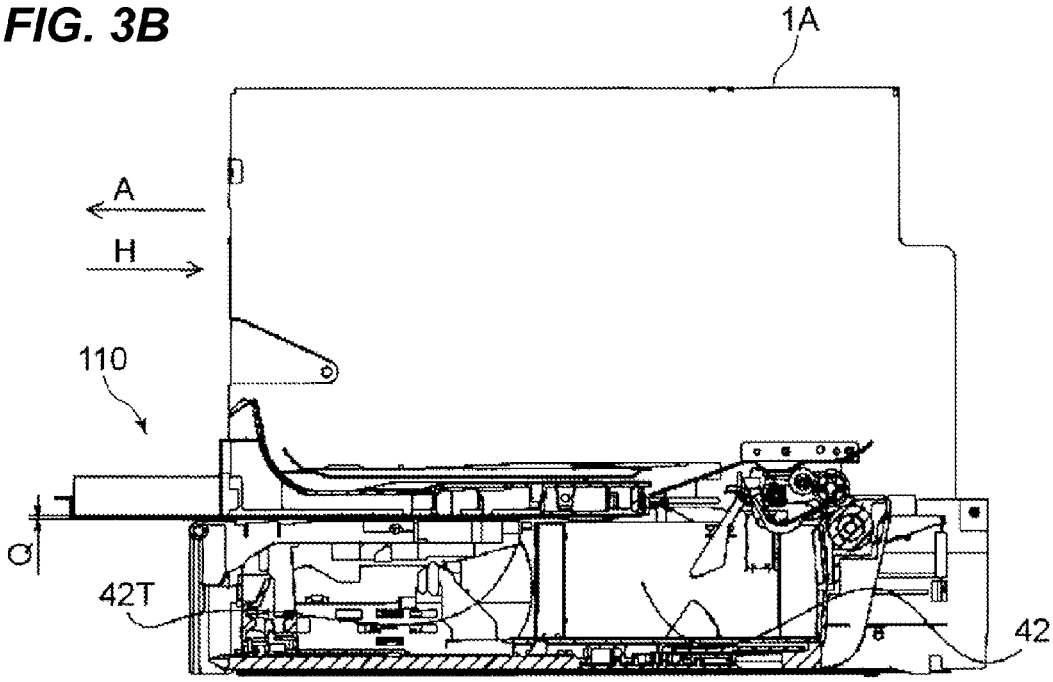

As illustrated in FIG. 3B, when the both-sided unit 110 is attached to the apparatus body 1A, a height-direction clearance Q between the both-sided unit 110 and the lateral-end regulating portions 42 and 43 ranges from about 1 mm to 5 mm. Because a height of the apparatus body is increased with increasing clearance Q, preferably the clearance Q is small.

As illustrated in FIGS. 3A and 4, first and second guide projections 100*a* and 100*c* which are of an upper regulating portion are integrally provided in the guide member 100. The guide projections 100*a* and 100*c* abut on the sheet to regulate the upward movement of the sheet when the sheet climbs over the projections 42T and 43T. Although not illustrated, the same guide projections are also provided in the guide member 101.

In the guide projections 100*a* and 100*c*, the first guide projection 100*a* on a downstream side in the sheet feeding direction is located in a position higher than the projection 42T, which is provided in the lateral-end regulating portion 42, by a distance Y2. The second guide projection 100*c* on an upstream side in the sheet feeding direction is located in a position higher than the projection 42T by a distance Y1. A relationship of Y1<Y2 holds in the distances Y1 and Y2. That is, in the plural (in the first embodiment, two) guide projections 100*a* and 100*c*, which are provided opposite the guide members 100 and 101 provided along the cassette attaching direction, the first guide projection 100*a* is provided above the second guide projection 100*c*.

As described above, in a case that the projection 42T is provided on the lateral-end regulating portion 42 of the sheet feeding cassette 4, the increased overlapping amount of the projection 42T largely degrades the usability when a user stores the sheets in the sheet feeding cassette. Therefore, in the first embodiment, the overlapping amount of the projection 42T of the lateral-end regulating portion 42 with the upper surface of the sheet is set within a proper range of about 1 mm to 5 mm such that the sheets can easily be set without damaging the end part of the sheet.

The first and second guide projections 100*a* and 100*c* are provided in the guide member 100 so as to overlap with the upper surface of the sheet. The overlapping amounts of the first and second guide projections 100*a* and 100*c* are properly set, whereby the upward movement of the sheet can be regulated even if the sheet climbs over (the projections 42T and 43T of) the lateral-end regulating portions 42 and 43. In other words, the upper surface of the sheet can be regulated by properly setting the overlapping amounts of the first and second guide projections 100*a* and 100*c*.

Figure 5:
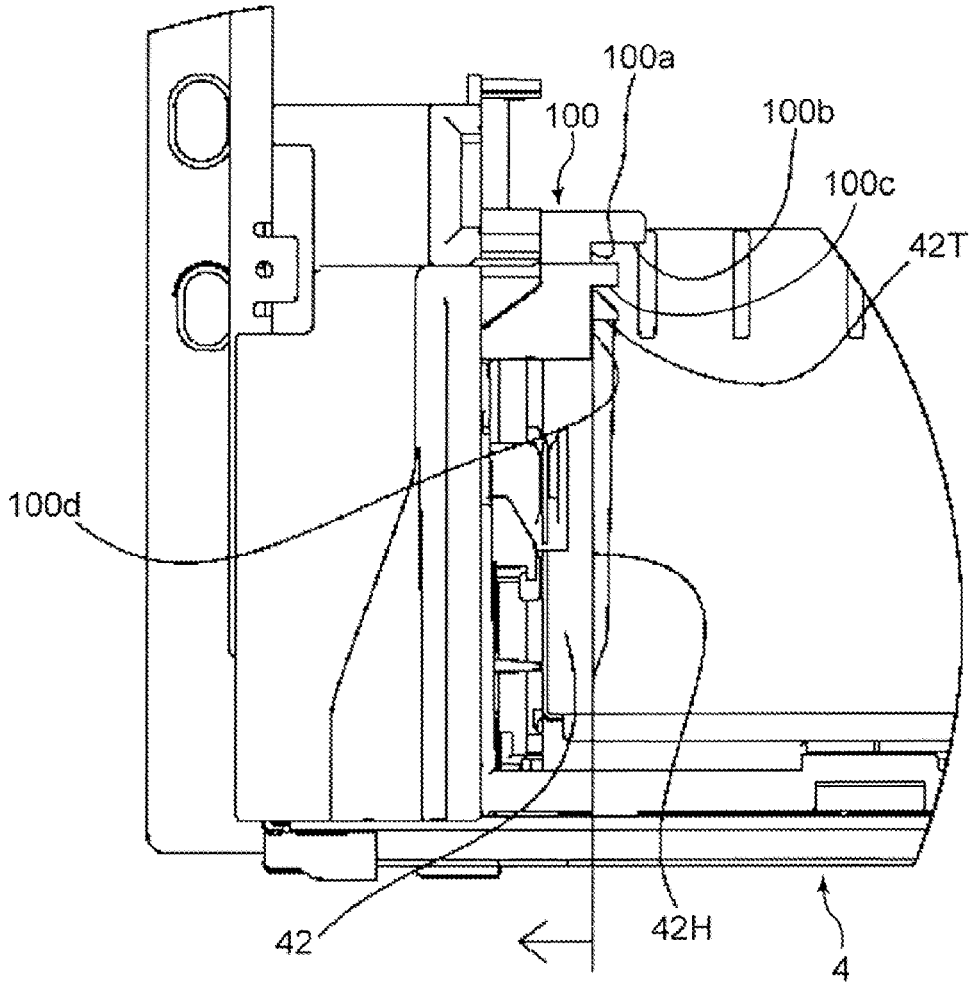
FIG. 5 is a view illustrating a configuration of a sheet feeding cassette attached to the sheet feeding apparatus.

As illustrated in FIG. 5, the lateral-end regulating portion 42 includes a position regulating surface 42H which abuts on a lateral end in the width direction of the sheet to regulate the position in the width direction of the sheet. The guide member 100 includes a first position regulating portion 100*b* which is located below the first guide projection 100*a* to regulate the position in the width direction of the sheet and a second position regulating portion 100*d* which is located below the second guide projection 100*c* to regulate the position in the width direction of the sheet.

The first and second position regulating portions 100*b* and 100*d* are provided, whereby the movement in the width direction of the sheet is regulated by the first and second position regulating portions 100*b* and 100*d* when the sheet climbs over the projection 42T of the lateral-end regulating portion 42. In order to regulate the movement in the width direction of the sheet, the first and second position regulating portions 100*b* and 100*d* are located close to the position regulating surface 42H of the lateral-end regulating portion 42 in the sheet feeding direction while located flush with or slightly outside the position regulating surface 42H in the width direction. Therefore, when the sheet is lifted or fed, or when the sheet climbs over the projection 42T, the sheet can smoothly be conveyed from the position regulating surface 42H to the first and second position regulating portions 100*b* and 100*d* while the end part of the sheet is not hung up.

Figure 9A:
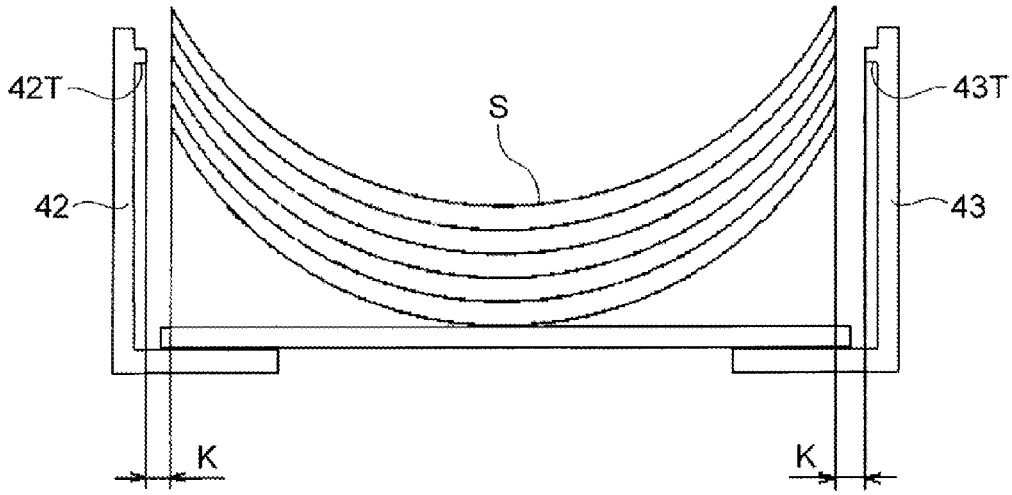
FIG. 9A PRIOR ART
FIGS. 9A and 9B are views illustrating a sheet stacking state of a sheet feeding cassette of the related art.
Figure 9B:
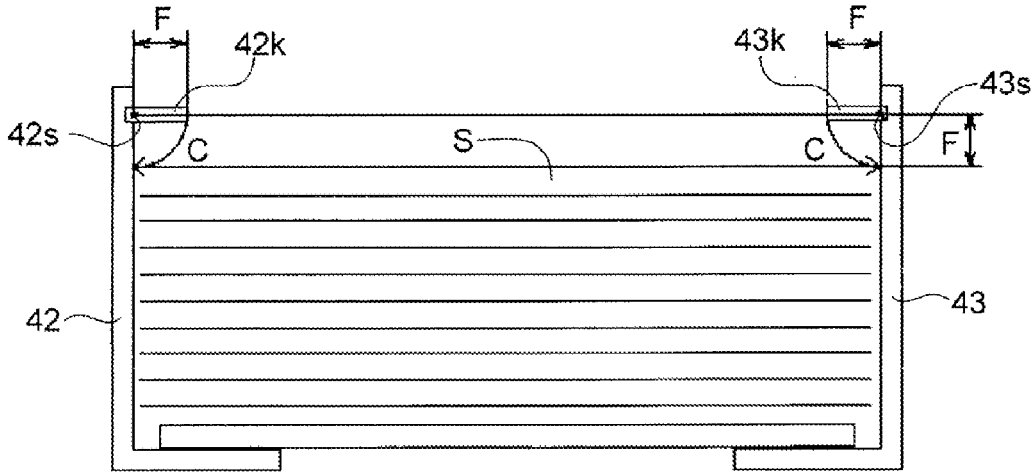
FIG. 9B PRIOR ART

As illustrated in FIG. 9A, sometimes sheets S set in the sheet feeding cassette 4 become the curl state in which the end part of the sheet is warped in a low-temperature, low-humidity environment. Particularly, the curl is easily generated in a thin sheet, and the curl is also observed in a standard-size sheet, such as a LTR-size sheet and an A4-size sheet, because various types having different thicknesses are sold. On the other hand, in the first embodiment, the first and second guide projections 100*a* and 100*c* are provided in the guide member 100, which allows a climbing-over amount to be regulated even if the sheet climbs over the lateral-end regulating portions 42 and 43.

Figure 6A:
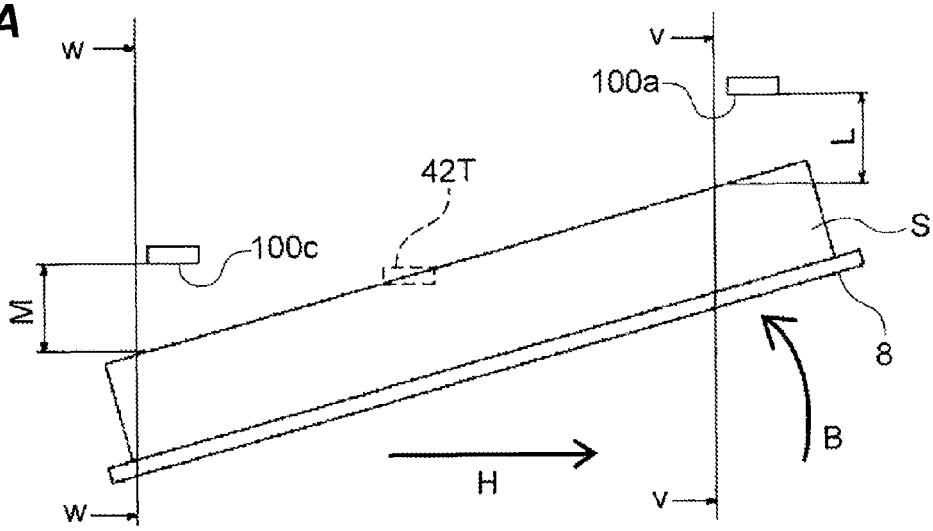
FIGS. 6A, 6B, and 6C are views illustrating a sheet feeding state of the sheet feeding cassette.

The sheet feeding cassette 4 having the above configuration in the sheet feeding state will be described below with reference to FIG. 6. When the sheet feeding cassette 4 is in the sheet feeding state, the sheet supporting plate 8 is lifted to a sheet surface detection level in a direction of an arrow B as illustrated in FIG. 6A. As described above, the first guide projection 100*a* on the downstream side is provided in the position higher than the second guide projection 100*c* on the upstream side.

Therefore, a difference between a distance L from the upper surface of the lifted sheet S to the first guide projection 100*a* and a distance M from the upper surface to the second guide projection 100*c* is small. That is, when the sheet supporting plate 8 is lifted, the distances L and M from the upper surface of the sheet S to the first and second guide projections 100*a* and 100*c* become substantially equal to each other. In other words, when the sheet supporting plate 8 is lifted, gaps between the sheet supporting plate 8 and the first and second guide projections 100*a* and 100*c* become substantially equal to each other.

Figure 6B:
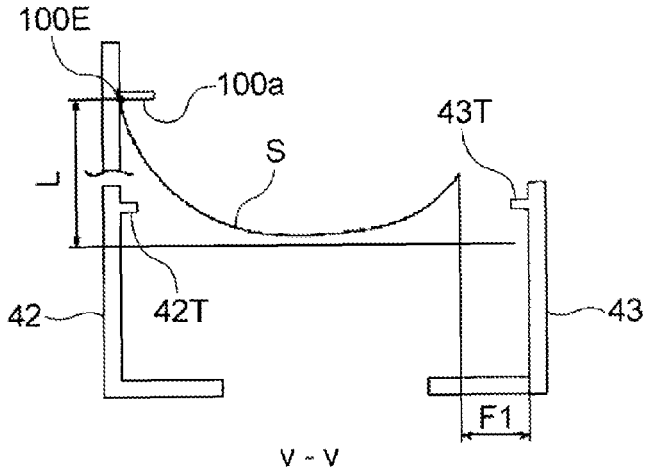

FIG. 6B is a sectional view taken on a line v-v of FIG. 6A, and FIG. 6B illustrates the state in which the end part of the sheet S climbs over the projection 42T of the lateral-end regulating portion 42 when the curled sheet S is fed. In this case, the end part of the sheet S is regulated by a base 100E of the first guide projection 100*a*. At this point, the sheet S shifts in the width direction, and a shift amount of the sheet S becomes a distance F1 from the lateral-end regulating portion 43 on the opposite side to the end part of the sheet.

Figure 6C:
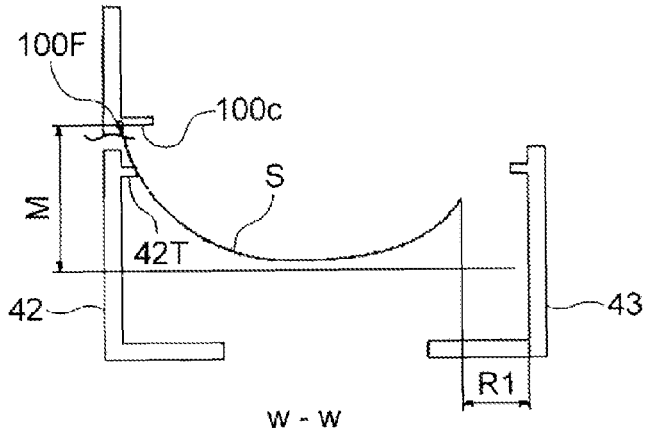

FIG. 6C is a sectional view taken on a line w-w of FIG. 6A. When the end part of the curled sheet S climbs over the projection 42T of the lateral-end regulating portion 42, the end part of the sheet S is regulated by a base 100F of the second guide projection 100*c*. At this point, the sheet S shifts in the width direction, and the shift amount of the sheet S becomes a distance R1 from the lateral-end regulating portion 43 on the opposite side to the end part of the sheet.

As described above, the heights of the upper surface of the sheet S and the first and second guide projections 100*a* and 100*c* are set such that the distances L and M from the upper surface of the sheet to the first and second guide projections 100*a* and 100*c* become substantially equal to each other when the sheet supporting plate 8 is lifted. Therefore, a difference between the distances F1 and R1 from the lateral-end regulating portion 43 on the opposite side to the end part of the sheet is small. As a result, the shift amounts are equalized at the leading end and the rear end of the sheet, so that a skew feeding amount of the sheet can be suppressed to a small level in feeding the sheet.

Figure 7A:
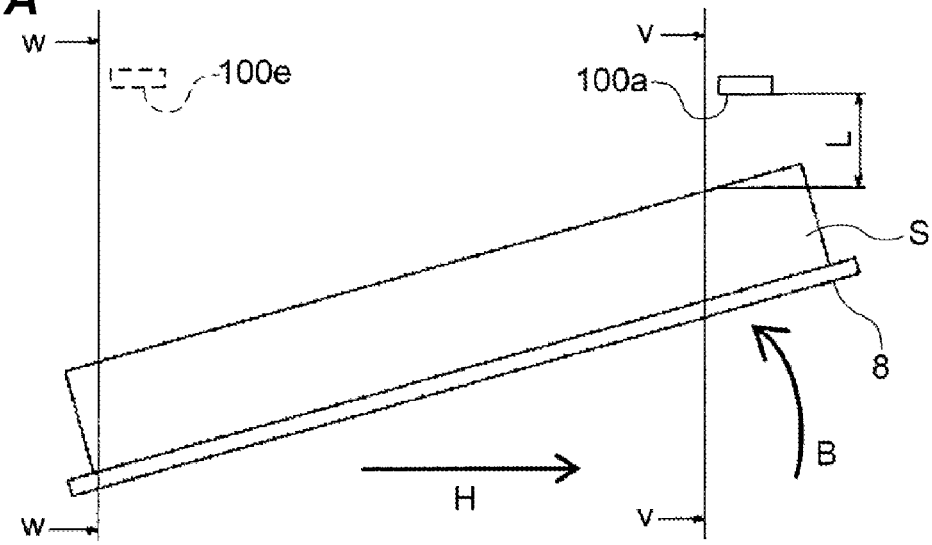
FIGS. 7A, 7B, and 7C are views illustrating a sheet feeding state of a sheet feeding cassette according to a comparative example of the first embodiment.
Figure 7B:
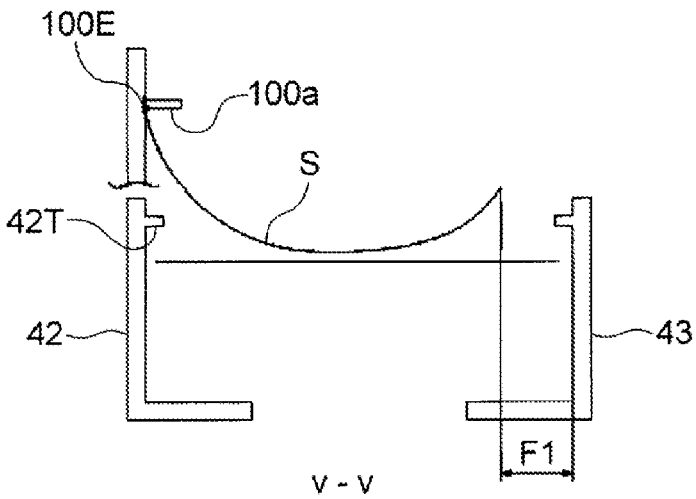

FIG. 7 illustrates a comparative example of the first embodiment. In the comparative example, as illustrated in FIG. 7A, a second guide projection 100*e* on the upstream side is set to the same height as the first guide projection 100*a*. In this case, as illustrated in FIG. 7B which is of the sectional view taken on the line v-v of FIG. 7A, when the end part of the sheet S climbs over the projection 42T of the lateral-end regulating portion 42, the sheet S shifts in the width direction, and the shift amount of the sheet S becomes the distance F1 from the lateral-end regulating portion 43 on the opposite side to the end part of the sheet.

Figure 7C:
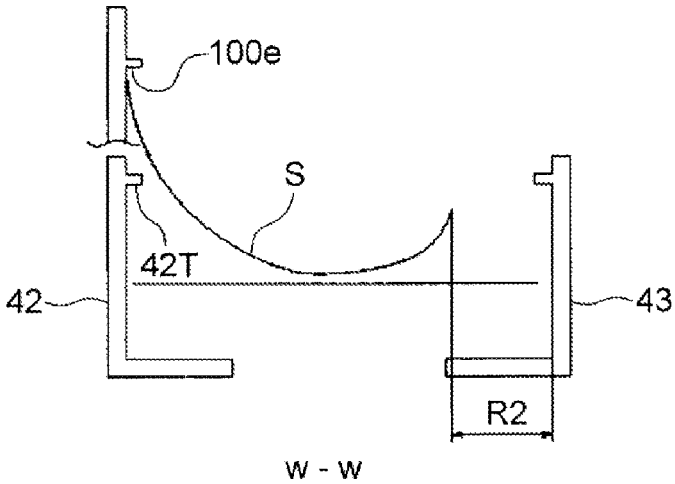

On the other hand, as illustrated in FIG. 7C which is of the sectional view taken on the line w-w of FIG. 7A, when the end part of the curled sheet S climbs over the projection 42T of the lateral-end regulating portion 42, the sheet S shifts in the width direction, and the shift amount of the sheet S becomes a distance R2 from the lateral-end regulating portion 43 on the opposite side to the end part of the sheet. At this point, the distance R2 becomes larger than the distance R1 in FIG. 6C to generate a difference between the shift amount at the leading end and the rear end of the sheet, which increases the skew feeding amount in feeding the sheet.

As described above, the skew feeding amount is increased in feeding the sheet when the second guide projection 100*e* is set to the same height as the first guide projection 100*a* on the downstream side. Therefore, in order to decrease the skew feeding amount, it is necessary that the second guide projection 100*c* be set to a position lower than the first guide projection 100*a* on the downstream side. That is, the skew feeding amount can be decreased by setting the second guide projection 100*c* to a position lower than the first guide projection 100*a* on the downstream side.

As described above, in the first embodiment, when the sheet is fed, the skew feeding amount can be decreased by providing the guide projections 100*a* and 100*c* in the guide members 100 and 101. Therefore, the good print accuracy can be obtained and the jam caused by the skew feeding can be reduced. The overlapping amounts of the projections 42T and 43T can be decreased by providing the guide projections 100*a* and 100*c* in the guide members 100 and 101, and the projections 42T and 43T can be prevented from interrupting the storage of the sheet. Therefore, a profile of the apparatus body 1A can be suppressed without degrading the usability. Additionally cost reduction can be achieved because the projections 42T and 43T are formed integrally with the guide members 100 and 101.

That is, when the sheet climbs over the lateral-end regulating portions 42 and 43, the upward movement of the sheet is regulated by the guide projections 100*a* and 100*c* provided in the guide members 100 and 101, so that the sheet feeding performance can be improved at low cost without degrading the usability.

Figure 8A:
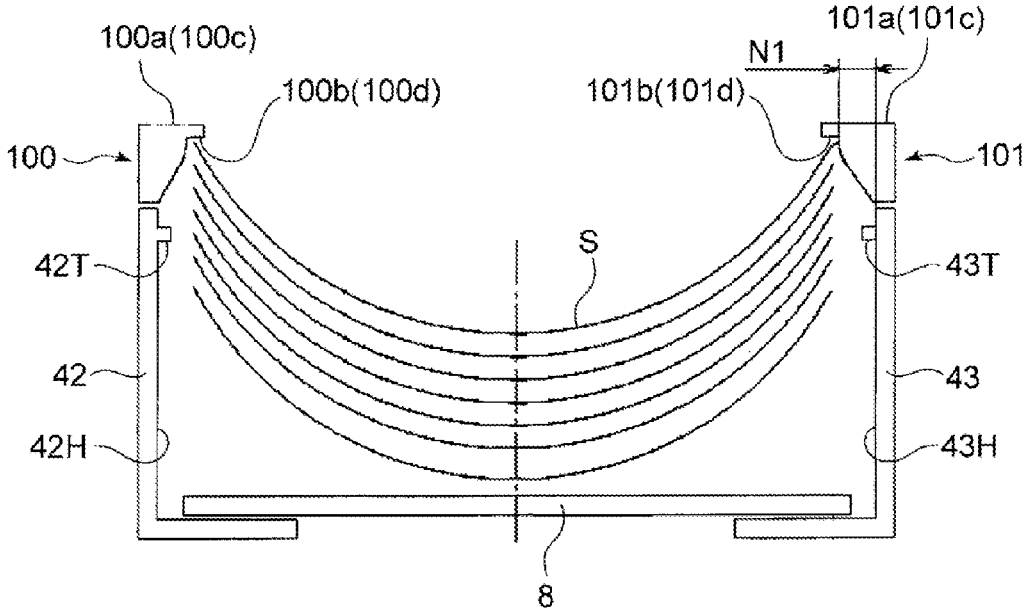
FIGS. 8A and 8B are views illustrating a configuration of a sheet feeding cassette attached to a sheet feeding apparatus according to a second embodiment of the invention.
Figure 8B:
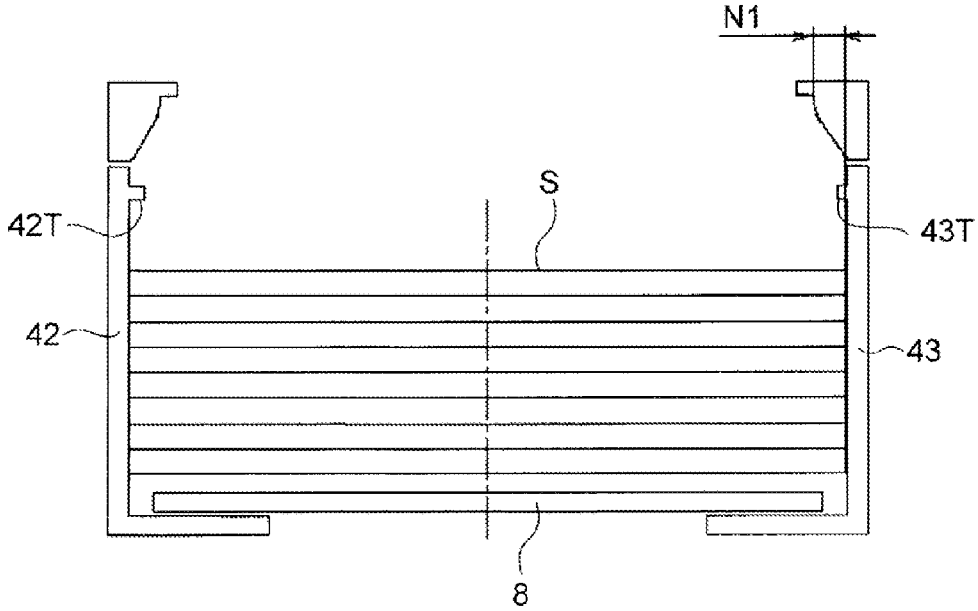

A second embodiment of the invention will be described below. FIG. 8 is a view illustrating a configuration of a sheet feeding cassette of a sheet feeding apparatus according to the second embodiment. In FIG. 8, the part identical or equivalent to that in FIG. 4 is designated by the identical numerals. FIG. 8A illustrates a state in which the sheet S is curled in the sheet feeding cassette, and FIG. 8B illustrated a state in which the sheet S is not curled.

As illustrated in FIG. 8, the lateral-end regulating portions 42 and 43 include the position regulating surfaces 42H and 43H. The guide member 100 includes the guide projections 100*a* and 100*c*. The guide member 100 also includes the position regulating portions 100*b* and 100*d* which are of the guide portion. The guide member 100 is provided below the guide projections 100*a* and 100*c*, and the position regulating portions 100*b* and 100*d* regulate the position in the width direction of the sheet while orienting the sheet, which climbs over the projection 42T, toward the guide projections 100*a* and 100*c*.

The guide member 101 which is provided opposite the guide member 100 includes the guide projection 101*a* and 101*c*. The guide member 101 also includes the position regulating portions 101*b* and 101*d*. The guide member 100 is provided below the guide projections 101*a* and 101*c*, and the position regulating portions 101*b* and 101*d* regulate the position in the width direction of the sheet while orienting the sheet, which climbs over the projection 43T, toward the guide projections 101*a* and 101*c*.

In the second embodiment, the position regulating portions 100*b* and 100*d* of the guide member 100 and the position regulating portions 101*b* and 101*d* of the guide member 101 are projected inward from the positions in FIG. 5. That is, the position regulating portions 101*b* and 101*d* of the guide member 101 are disposed inside by a distance N1 in the width direction with respect to the position regulating surface 43H of the lateral-end regulating portion 43. The position regulating portions 100*b* and 100*d* of the guide member 100 are also disposed inside by the distance N1 in the width direction with respect to the position regulating surface 42H of the lateral-end regulating portion 42. That is, the position regulating portions 100*b*, 100*d*, 101*b*, and 101*d* are projected toward the upward direction of the sheet with respect to the position regulating surfaces 42H and 43H.

For example, when the sheet S is left in the low-temperature, low-humidity environment, the end part of the sheet S is curled, the sheet S is warped from the state in FIG. 8B to the state in FIG. 8A, and the sheet S off-sets inward by the distance N1 on both the sides in the width direction. When the guide projections 100*a*, 100*c*, 101*a*, and 101*c* are not provided, the curled sheet S is regulated in the positions corresponding to the position regulating surfaces 42H and 43H. At this point, when the sheet S is fed, a margin at the left or right end of the sheet S shifts by the distance N1, or a clearance for the distance N1 is generated between both the end of the sheet and the position regulating portions. Therefore, the skew feeding is easily generated.

On the other hand, in the second embodiment, the position regulating portions 101*b* and 101*d* of the guide member 101 and the position regulating portions 100*b* and 100*d* of the guide member 100 are disposed inward by the distance N1 in the width direction. Therefore, when the sheet climbs over the lateral-end regulating portions 42 and 43, the sheet moves toward the guide projections 100*a*, 100*c*, 101*a*, and 101*c* while being guided by the position regulating portions 100*b*,

100*d*, 101*b*, and 101*d*. Then the upward movement of the sheet is regulated by the guide projections 100*a*, 100*c*, 101*a*, and 101*c*. Therefore, the sheet feeding performance can be improved at low cost without degrading the usability.

As described above, in the second embodiment, the position regulating portions 100*b*, 100*d*, 101*b*, and 101*d* are projected inward by the distance N1 in the width direction with respect to the position regulating surfaces 42H and 43H. Therefore, when the curled sheet S climbs over the projection 42T and 43T of the lateral-end regulating portions 42 and 43, the sheet S can securely be oriented toward the guide projections 100*a*, 100*c*, 101*a*, and 101*c*. Accordingly, the upward movement of the sheet S can securely be regulated, and the print accuracy of the margin of the sheet S can be improved, and a possibility of the jam caused by the skew feeding can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-172872, filed Aug. 8, 2011, which is hereby incorporated by reference herein in its entirety.

What is claimed is:

1. A sheet feeding apparatus comprising:

a sheet feeding cassette detachably attached to an apparatus body, which stores sheets;

a sheet feeding portion which feeds the sheet stored in the sheet feeding cassette;

a pair of lateral-end regulating portions which is provided in the cassette to regulate a lateral-end position of the sheet in a width direction orthogonal to a sheet feeding direction;

a regulating portion which is projected from an abutting surface of each of the pair of lateral-end regulating portions, the abutting surface abutting on a lateral end of the sheet, the regulating portion regulating climbing over the pair of lateral-end regulating portions of the sheet when the sheet is fed; and an upper regulating portion which projects from an inner wall surface of an attaching space, in which the sheet feeding cassette of the apparatus body is attached, and regulates the sheet when the sheet climbs over the regulating portion.

2. The sheet feeding apparatus according to claim 1, further comprising a plurality of upper regulating portions provided opposite each other along a cassette attaching direction, and, in the plurality of upper regulating portions, an upper regulating portion on a downstream side in the sheet feeding direction is provided in a position higher than an upper regulating portion on an upstream side in the sheet feeding direction.

3. The sheet feeding apparatus according to claim 2, wherein a guide portion is provided while projected in the width direction from the abutting surface, the guide portion orienting the sheet, which climbs over the regulating portion, toward the plurality of upper regulating portions provided opposite each other.

4. The sheet feeding apparatus according to claim 1, wherein a guide member which extends along the cassette attaching direction in the inner wall surface of the attaching space is provided, the guide member being located above the sheet feeding cassette when the sheet feeding cassette is attached, and the upper regulating portion is provided in the guide member.

5. A sheet feeding apparatus comprising:

a sheet feeding cassette detachably attached to an apparatus body, which stores sheets;

a sheet feeding portion which feeds the sheet stored in the sheet feeding cassette;

a pair of lateral-end regulating portions which is provided in the cassette to regulate a lateral-end position of the sheet in a width direction orthogonal to a sheet feeding direction;

a regulating portion which is projected to a position higher than an upper surface of the stacked sheet in an abutting surface of each of the pair of lateral-end regulating portions, the abutting surface abutting on a lateral end of the sheet; and an upper regulating portion which is projected onto the sheet feeding cassette side at a position higher than the regulating portion from an inner wall surface of an attaching space, in which the sheet feeding cassette of the apparatus body is attached.

6. The sheet feeding apparatus according to claim 5, further comprising a plurality of upper regulating portions provided opposite each other along a cassette attaching direction, and, in the plurality of upper regulating portions, an upper regulating portion on a downstream side in the sheet feeding direction is provided in a position higher than an upper regulating portion on an upstream side in the sheet feeding direction.

7. The sheet feeding apparatus according to claim 5, wherein a guide member which extends along the cassette attaching direction in the inner wall surface of the attaching space is provided, the guide member being located above the sheet feeding cassette when the sheet feeding cassette is attached, and the upper regulating portion is provided in the guide member.

8. An image forming apparatus comprising:

an image forming portion; and a sheet feeding apparatus which feeds a sheet to the image forming portion, the sheet feeding apparatus including:

a sheet feeding cassette detachably attached to the image forming portion, which stores sheets;

a feeding portion which feeds a sheet stored in a sheet feeding cassette;

a pair of lateral-end regulating portions which is provided in the cassette to regulate a lateral-end position of the sheet in a width direction orthogonal to a sheet feeding direction;

a regulating portion which is projected from an abutting surface of each of the pair of lateral-end regulating portions, the abutting surface abutting on a lateral end of the sheet, the regulating portion regulating climbing over the pair of lateral-end regulating portions of the sheet when the sheet is fed; and an upper regulating portion which projects from an inner wall surface of an attaching space, in which the sheet feeding cassette of the apparatus body is attached, and regulates the sheet when the sheet climbs over the regulating portion.

9. The image forming apparatus according to claim 8, further comprising a plurality of upper regulating portions are provided opposite each other along a cassette attaching direction, and, in the plurality of upper regulating portions, an upper regulating portion on a downstream side in the sheet feeding direction is provided in a position higher than an upper regulating portion on an upstream side in the sheet feeding direction.

10. The image forming apparatus according to claim 9, wherein a guide portion is provided while projected in the width direction from the abutting surface, the guide portion orienting the sheet, which climbs over the regulating portion, toward the plurality of upper regulating portions provided opposite each other.

11. The image forming apparatus according to claim 8, wherein a guide member which extends along the cassette attaching direction in the inner wall surface of the attaching space is provided, the guide member being located above the sheet feeding cassette when the sheet feeding cassette is attached, and the upper regulating portion is provided in the guide member.

12. An image forming apparatus comprising:

an image forming portion; and a sheet feeding apparatus which feeds a sheet to image forming portion, the sheet feeding apparatus including:

a sheet feeding cassette detachably attached to the image forming portion, which stores sheets;

a feeding portion which feeds a sheet stored in a sheet feeding cassette;

a pair of lateral-end regulating portions which is provided in the cassette to regulate a lateral-end position of the sheet in a width direction orthogonal to a sheet feeding direction;

a regulating portion which is projected to a position higher than an upper surface of the stacked sheet in an abutting surface of each of the pair of lateral-end regulating portions, the abutting surface abutting on a lateral end of the sheet; and an upper regulating portion which is projected onto the sheet feeding cassette side at a position higher than the regulating portion in an inner wall surface of an attaching space, in which the sheet feeding cassette of the apparatus body is attached.

13. The image forming apparatus according to claim 12, further comprising a plurality of upper regulating portions are provided opposite each other along a cassette attaching direction, and, in the plurality of upper regulating portions, an upper regulating portion on a downstream side in the sheet feeding direction is provided in a position higher than an upper regulating portion on an upstream side in the sheet feeding direction.

14. The image forming apparatus according to claim 12, wherein a guide member which extends along the cassette attaching direction in the inner wall surface of the attaching space is provided, the guide member being located above the sheet feeding cassette when the sheet feeding cassette is attached, and the upper regulating portion is provided in the guide member.

* * * * *